United States Patent [19]

Markham

[11] Patent Number: 5,051,758

[45] Date of Patent: Sep. 24, 1991

[54] CLEAN PRINTHEAD CLEANER

[75] Inventor: Roger G. Markham, Webster, N.Y.

[73] Assignee: Xerox Corporation, Stamford, Conn.

[21] Appl. No.: 528,765

[22] Filed: May 25, 1990

[51] Int. Cl.[5] ..... B41J 2/165

[52] U.S. Cl. ..... 346/140 R

[58] Field of Search ..... 346/140; 400/701, 702, 400/702.1; 15/256.52, DIG. 12, 97.1; 101/423, 425

[56] References Cited

U.S. PATENT DOCUMENTS

| | | | |
|---|---|---|---|
| 4,112,435 | 9/1978 | Kattner et al. . | |
| 4,177,471 | 12/1979 | Mitchell . | |
| 4,252,448 | 2/1981 | Johnson et al. . | |
| 4,306,245 | 12/1981 | Kasugayama | 346/140 |
| 4,370,050 | 1/1983 | Matsui et al. . | |
| 4,371,881 | 2/1983 | Bork et al. . | |
| 4,401,990 | 8/1983 | Aiba et al. . | |
| 4,567,494 | 1/1986 | Taylor . | |
| 4,601,777 | 7/1986 | Hawkins et al. . | |
| 4,706,320 | 11/1987 | Swift . | |
| 4,745,414 | 5/1988 | Okamura et al. . | |
| 4,853,717 | 8/1989 | Harmon et al. | 346/140 R |
| 4,935,753 | 6/1990 | Lehmann et al. | 346/140 |

FOREIGN PATENT DOCUMENTS 0019185 1/1984 Japan .

0288047 12/1987 Japan .

OTHER PUBLICATIONS

Nozzle Guard and Maintenance Station for Drop-o-n-Demand Printheads, IBM TDB, vol. 27, No. 12, May 1985, pp. 6965-6967.

Impeller-Assisted Cleaning Blade, IBM TDB, vol. 31, No. 6, Nov. 1988, pp. 153-154.

*Primary Examiner*—Joseph W. Hartary

*Attorney, Agent, or Firm*—Oliff & Berridge

[57] ABSTRACT

A rotary cleaning device for an ink jet type printer including a cylindrical supporting member having a flexible wiping blade thereon which is rotated in the motion path of printhead nozzles to facilitate cleaning ink and contaminants from the nozzle-containing face of the printhead is disclosed. The wiping blade runs along a helical path of the cylindrical supporting member to wipe the nozzles at an angle dependent upon the pitch of the helical path. The device may further include a sponge washing blade which runs in advance of the first wiping blade to wash the nozzle-containing face prior to wiping. Further, a cleaning device may be included to clean the blade(s) of any contaminants prior to the next rotation of the device to prevent removed ink or contaminants from further contact with the nozzle-containing face.

41 Claims, 3 Drawing Sheets

CLEAN PRINTHEAD CLEANER

BACKGROUND OF THE INVENTION

1. Field of the Invention

This invention relates to cleaning devices for ink jet type printers and, more particularly, to a rotary cleaning device for ink jet printers which removes contaminants such as ink and dust from the nozzle-containing face of a printhead by rotation of at least one flexible blade member.

2. Description of the Related Art

In ink jet printers of the carriage type, a printhead containing a plurality of nozzles is located on a carriage which is reciprocated across a printing zone to effect printing onto a recording medium (i.e., paper). Due to the close tolerances between the recording medium and the nozzles and the small size of the nozzle outlets, it is common for such nozzles to become clogged and perform unreliably due to contaminants becoming lodged in the nozzles and on the front face of the printhead. Additionally, ink and other contaminants which collect on the front face of the printhead can also have an adverse influence on the formation of droplets made by the nozzles. Numerous devices attempt to remove collected ink and other contaminants from the nozzle-containing faces of printheads in various ways.

U.S. Pat. No. 4,745,414 to Okamura et al discloses a recovery device for an ink jet recorder which includes a wiping blade which can be advanced to contact or retracted to be spaced from the nozzle-containing face of a printhead. Movement of the printhead along a carriage path relative to the laterally stationary wiping blade provides the wiping action. The construction of Okamura et al tends to fling the material removed from the printhead nozzle face into adjacent portions of the printer. It is also impossible to wipe the nozzle face more than once without reciprocating the printhead along the carriage path which reciprocation is not easily obtained.

U.S. Pat. No. 4,401,990 to Aiba et al discloses a nozzle cleaning device for an ink jet printer system in which a nozzle and a slidable member are disposed on a carriage. The slidable member includes an absorptive cleaning pad which either covers the nozzle the entire time the printer is off or only momentarily when the printer is turned on. The cleaning pad is of a nonwoven cloth and only serves to absorb liquid ink from the nozzle. The device of Aiba et al provides no means for washing of the nozzle and only wipes the nozzle momentarily when the slidable member first approaches the nozzle.

U.S. Pat. No. 4,371,881 to Bork et al discloses a pivotal shield for an ink jet recording device head whereby the shield is movable relative to the writing head to shield, wipe and permit flushing of the writing head outlets. The device of Bork et al uses a resilient wiper element which engages the writing head surface and provides a vertical wiping motion to remove ink from the head.

U.S. Pat. No. 4,853,717 to Harmon et al discloses a service station for an ink jet printer which comprises a pump means for priming an ink jet cartridge, a sled to actuate the service station and a wiping blade for cleaning the printhead. The wiping blade is a stationary resilient piece of rubber which is mounted on a stationary bracket. The wiper is located in the path of the printhead carriage so that it wipes the nozzle-containing face of the printhead during a portion of the printhead travel path. The construction of Harmon et al also tends to fling material removed from the printhead into adjacent portions of the printer and the wiping motion cannot be repeated without reciprocating the printhead and carriage.

U.S. Pat. No. 4,112,435 to Kattner et al discloses a cover and cleaning device for an ink jet recorder which has a wiping arm which wipes the nozzle-containing face of a writing head during movement between a blocking position and an operative position. Once again, this device tends to fling material removed from the printhead into surrounding portions of the printer.

U.S. Pat. No. 4,370,050 to Matsui et al discloses a pre-transfer cleaning device for an image transfer copying apparatus which has a longitudinally extending cleaning pad of foamed polyurethane which frictionally contacts the surface of a dielectric face to remove dust. The pad is retractable to engage with a brush which cleans the pad and removes the dust into an underlying receptacle. The device of Matsui et al does not clean ink jet printheads.

U.S. Pat. No. 4,706,320 to Swift discloses an electrostatic cleaning brush comprising a cylindrical core and spirally wound fabric. The cleaning brush is rotated by a D.C. motor and cleans a photoconductive belt by electrostatic attraction. The device of Swift does not include a wiping blade and does not clean an ink jet printhead.

U.S. Pat. No. 4,252,448 to Johnson et al discloses a head cleaning apparatus for an electroresistive printer which has a cleaning brush. The head moves over the brush in a first direction and then immediately back in a reverse direction while pulling the head away from the brush. The cleaning brush of Johnson et al tends to fling material into adjacent printer components.

U.S. Pat. No. 4,177,471 to Mitchell discloses a carriage for an ink jet printer. The printer includes a cap which is positioned over a printhead array during non-use. Ink left on the cap is removed from the cap by a doctor blade and a pad wet with glycerine.

Most of the above-mentioned devices provide some degree of cleaning of ink jet printhead nozzle-containing faces. A problem with these cleaning devices is that they fling ink and other contaminants to surrounding portions of the printer and, in particular, onto the recording medium. Additionally, with the devices which rely upon the carriage movement to move the printhead over the cleaning blade, it is difficult to repeat the cleaning action since the entire carriage must be reciprocated. Another problem is the difficulty in removing dried ink from nozzle faces with just a wiping blade. A further problem, not addressed in previous ink jet cleaning devices, is the deteriorating efficiency of wiping blades due to the accumulation of dried ink and other contaminants on the cleaning blade. Once the blade has removed ink from a printhead face, the blade needs to have the ink removed therefrom so that the ink and other contaminants do not accumulate on the blade.

OBJECTS AND SUMMARY OF THE INVENTION

It is an object of the present invention to provide a cleaning device for an ink jet printer which reliably cleans the nozzle-containing face of a printhead.

Another object of the present invention is to provide a cleaning device for an ink jet printer which cleans the nozzle-containing face while minimizing the flinging of ink to surrounding portions of the printer.

Another object of the present invention is to provide an ink jet printhead nozzle face cleaning device with means for washing the nozzles prior to wiping to aid in removal of dried ink from the nozzle-containing face.

Another object of the present invention is to provide a cleaning device which further cleans the blade with a cleaning means preferably of the wet wick type to remove any contaminants from the blade.

A further object of the present invention is to provide a cleaning device for an ink jet printer which may be easily serviced or replaced.

To achieve the foregoing and other objects, and to overcome the shortcomings discussed above, a rotary cleaning device for periodically cleaning printhead nozzles in an ink jet printing system is provided. The rotary cleaning device of the present invention comprises at least one flexible wiping blade which is attached to a rotatable support. The rotatable support is attached to a shaft which is rotatably driven by a dedicated D.C. motor or connected through a clutch linkage to be driven off a motor already existing in the printer. The support is preferably cylindrical and the flexible wiping blade preferably follows a helical path along the circumferential surface of the support. During rotation of the support, the wiping blade contacts the front face of the printhead and effectively wipes the front face and nozzles of any ink or contaminants. Since the wiping does not rely on the movement of the carriage, flinging of removed contaminants is reduced. Additionally, if the support cylinder axis is parallel to the row of nozzles on the printhead and the wiping blade follows a helical path on the support, the blade will wipe the nozzles at an angle to the row that depends on the pitch of the helical path to further reduce undesirable flinging of removed ink and contaminants. The cleaning device preferably further includes a blade cleaning means located on a side of the support opposite the nozzles for removing any contaminants from the wiping blade to prevent further contact of the contaminants with the nozzles and to prevent deterioration of the wiping quality of the wiping blade. A wet-type washing blade may be added to the support to provide a washing of the printhead nozzle face with, for example, a solvent prior to wiping to aid in removal of dried ink. The cleaning device can adequately clean the printhead nozzle-containing face in one revolution or can be rotated through multiple revolutions if necessary.

BRIEF DESCRIPTION OF THE DRAWINGS

The invention will be described in detail with reference to the following drawings in which like reference numerals refer to like elements and wherein.

DETAILED DESCRIPTION OF THE PREFERRED EMBODIMENTS

Figure 1:
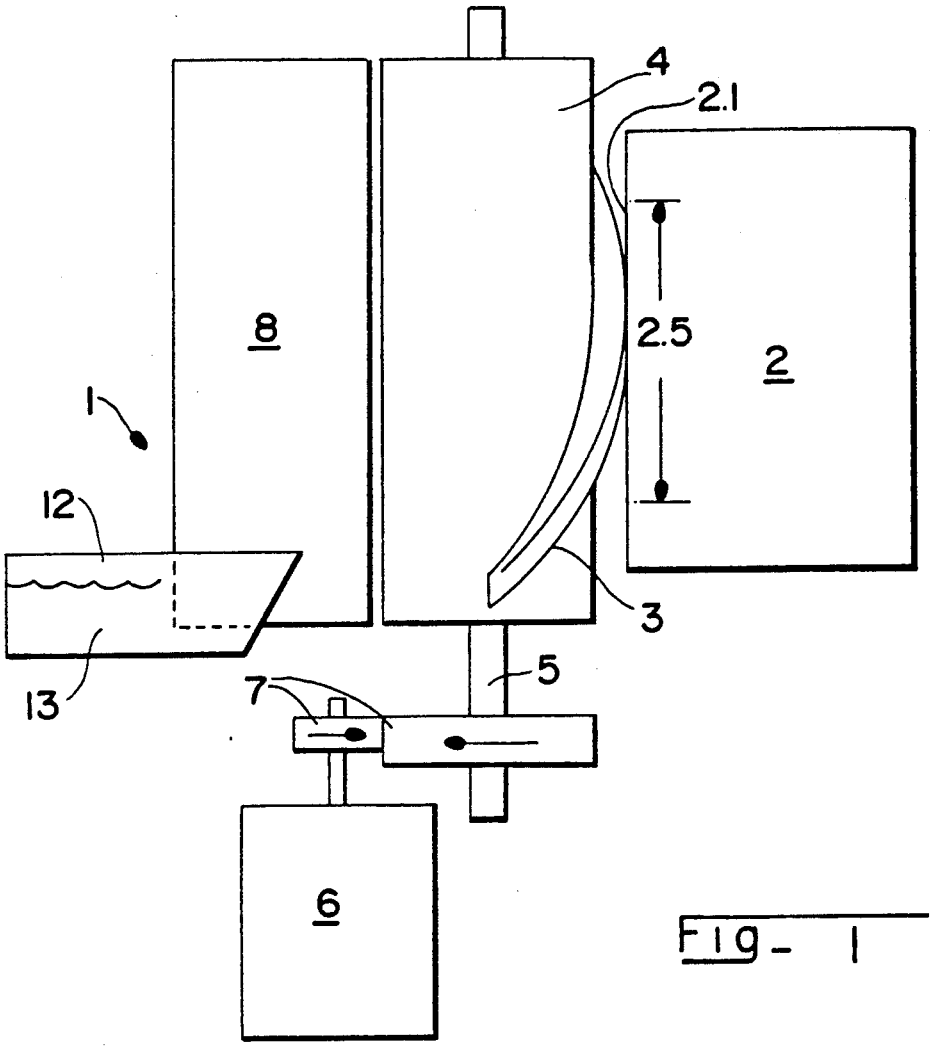
FIG. 1 is a side view of a cleaning device according to the present invention.
Figure 2:
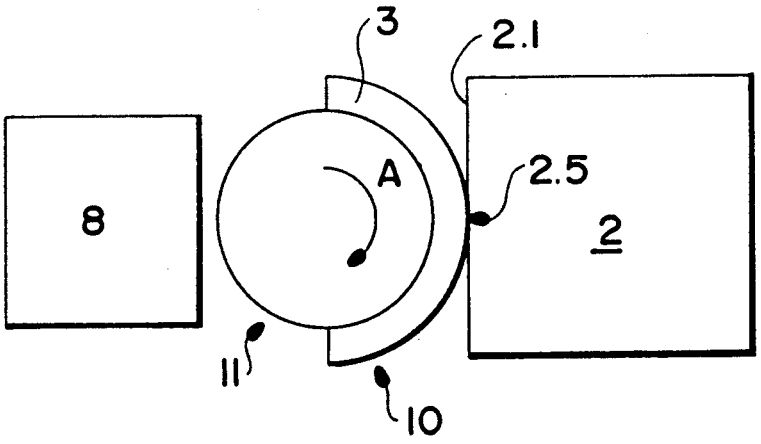
FIG. 2 is a top view of the cleaning device shown in FIG. 1.
Figure 5:
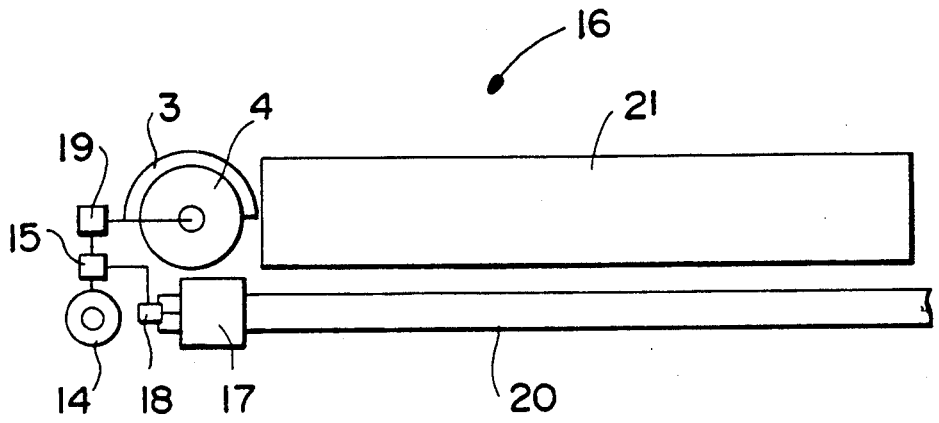
FIG. 5 is a top diagrammatical view of a portion of a printer including a cleaning device of the present invention which uses a carriage drive motor to drive the cleaning device.
Figure 6:
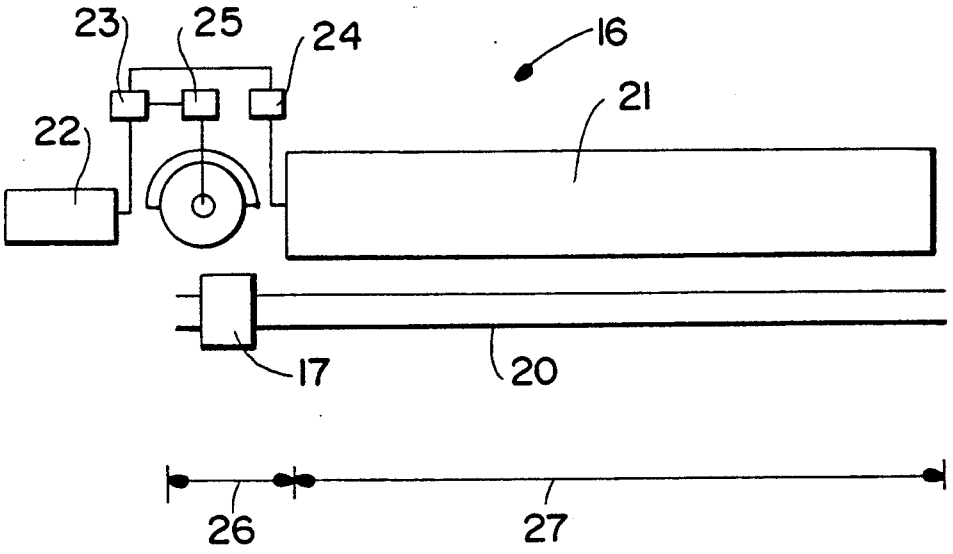
FIG. 6 is a diagrammatical top view of a portion of a printer including a cleaning device of the present invention which uses a platen drive motor to drive the cleaning device.

Referring now to the drawings and in particular to FIGS. 1 and 2, there is shown a cleaning device 1 for an ink jet printer which removes ink and other contaminants from the nozzle containing face 2.1 of a printhead 2. Cleaning device 1 comprises at least one flexible wiping blade 3 which is attached to a rotatable support 4, preferably being cylindrical in shape. Support 4 is attached to a shaft 5 which is engaged with, for example, a D.C. motor 6 through reduction gears 7 to provide a rotation means for support 4. Alternatively, as shown in FIG. 5, the rotating means may include a carriage motor 14 of printer 16, and clutch means 15 which can alternately attach carriage motor 14 to either a printer carriage 17, on which a printhead is attached, through a linkage 18, for reciprocation along track 20, or to cleaning device 1 through linkage 19. As a further alternative, shown in FIG. 6, rotating means may include a platen motor 22 of printer 16, and clutch means 23 which can alternately attach platen motor 22 to either a printer platen 21 through linkage 24, or to cleaning device 1 through linkage 25.

Upon activation by any of the above-mentioned rotating means, support 4 and attached wiping blade 3 are rotated to provide wiping contact between wiping blade 3 and the nozzle-containing face 2.1 of the printhead 2. The axis of support 4 is preferably parallel to the row (or rows) 2.5 of nozzles on the face 2.1 of printhead 2. Wiper blade 3 preferably follows a helical path on support 4, such a helical path allowing wiping blade 3 to contact the row of nozzles 2.5 at an angle dependent on the pitch of the helical path. The use of a helical wiping blade greatly improves the cleaning ability of cleaning device 1 over that of cleaning devices which utilize a straight wiping blade. The helical wiping blade also reduces the flinging of ink to surrounding portions of printer 16 because only a small portion of blade 3 contacts face 2.1 of printhead 2 at any instant in time. By rotating blade 3 around support 4 with only a small portion of blade 3 in contact with face 2.1 of printhead 2 at any instant in time, the entire blade is not removed from the nozzle-containing face 2.1 at one time and therefore the amount of ink which is flung is greatly reduced. Additionally, by rotating support 4 in a direction indicated by arrow A in FIG. 2, which moves blade 3 across the row of nozzles 2.5 in a direction away from certain components of the printer (e.g, the platen which includes the recording medium), any material which is flung is directed away from these components. By locating wiping blade 3 on only a partial circumference of support 4 so that a complete revolution of support 4 results in a blade-to-nozzle contacting portion 10 of cleaning device 1 and a blade to nozzle non-contacting portion 11 of cleaning device 1, blade 3 can be positioned away from printhead 2 when the carriage moves toward and away from cleaning device 1 to further reduce the chances of contaminants being flung.

Cleaning device 1 can also include cleaning means 8 which is preferably located adjacent a side of support 4 opposite from printhead 2. Cleaning means 8 is located so that it contacts wiping blade 3 during a portion of the rotation of support 4 for removing ink or other contaminants from wiping blade 3 to eliminate the contaminants from further contacting the nozzles and to prevent deterioration of the effectiveness of wiping blade 3 over time. Cleaning means 8 may be supplied with a cleaning solution 13 from wetting means 12. Wetting means 12 is preferably of the wet wick type whereby cleaning solution 13 moves from a source to cleaning means 8 by wicking-action. The cleaning solution 13 preferably should be a solvent which breaks up or disperses the ink. Preferably, cleaning means 8 is a sponge which can have a smooth polymer fabric or mesh covering for protection. The smooth polymer fabric or mesh covering can be, for example, a nylon mesh of the type used to produce parachutes.

Figure 3:
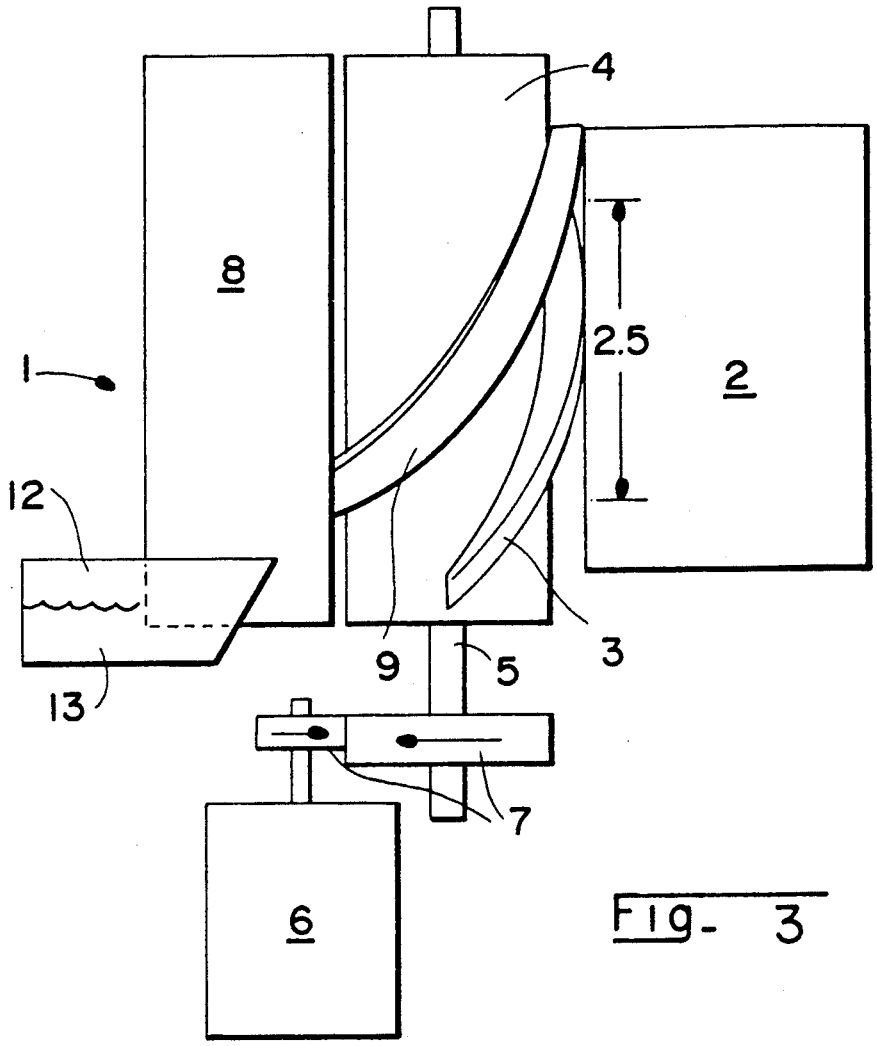
FIG. 3 is a side view of a cleaning device according to another embodiment of the present invention.
Figure 4:
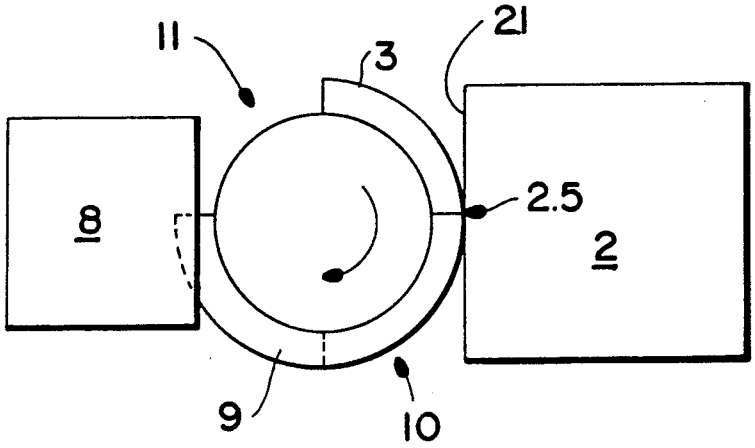
FIG. 4 is a top view of the cleaning device shown in FIG. 3.

Referring to FIGS. 3 and 4, a wet washing blade 9 further may be added to provide a washing capability to cleaning device 1. Wet washing blade 9 can be included in a cleaning device which has only flexible wiping blade 3, or both flexible wiping blade 3 and blade cleaning means 8. Wet washing blade 9 can be, for example, a sponge-like material covered with a smooth polymer fabric or mesh for protection and to provide a smooth surface for contacting printhead 2 and is preferably formed into a helical pattern similar to wiping blade 3. Wiping blade 3 and wet washing blade 9 are attached to and extend along respective paths on an outer circumference of support 4 so that wet washing blade 9 contacts the nozzle-containing face 2.1 of printhead 2 prior to wiping blade 3 to wash nozzle-containing face 2.1 prior to wiping thereof by wiping blade 3. Wet washing blade 9 aids in removing dried ink from face 2.1 of printhead 2 by dissolving any dried ink prior to wiping. As stated earlier, it is preferable to position the blades of cleaning device 1 on support 4 so that they can be positioned away from nozzle-containing face 2.1 when printhead 2 is moved toward and away from cleaning device 1 to prevent flinging of contaminating material by the blades. Thus, washing blade 9 and wiping blade 3 are located on only a partial circumference of support 4 so that a complete revolution of support 4 results in a blade-to-nozzle contacting portion 10 of cleaning device 1 and a blade-to-nozzle non-contacting portion 11 of cleaning device 1.

Various means of supplying a cleaning solution to wet washing blade 9 are possible. Preferably, wet washing blade 9 and flexible wiping blade 3 are located on support 4 so that wet washing blade 9 is in intimate contact with cleaning means 8 when the nozzle non-contacting portion 11 of cleaning device 1 is adjacent printhead 2 so that wetting of washing blade 9 occurs through a wicking effect from cleaning means 8. Alternatively, support 4 may have a portion which is constructed of a material which is capable of providing wet washing blade 9 with cleaning solution through wicking. In this case, a cleaning solution may be supplied to support 4 through tubing connected on one end to a supply of cleaning solution and on the other end to shaft 5 which, preferably, would be hollow and have holes located on the outer circumference thereof for disbursing the cleaning solution 13 to support 4.

All of the components of cleaning device 1 are easily removed to accommodate cleaning or replacement of dirty or worn components. If a solvent is used as the cleaning solution for cleaning means 8 and for wet washing blade 9 the ink contained on the blade(s) and cleaning means will dissolve and therefore the components should only require changing when dirt or other contaminants not dissolved by solvent accumulate on the components.

Upon rotation of cleaning device 1 according to any of the above described preferred embodiments, the blade(s) 3, 9 on support 4 will either be adjacent to or located away from printhead 2 depending on whether the contacting portion 10 or noncontacting portion 11 of cleaning device 1 is positioned adjacent printhead 2. When the contacting portion 10 of cleaning device 1 is positioned adjacent printhead 2, the wiping blade 3 and/or wet washing blade 9 will engage front face 2.1 of printhead 2 to provide wiping and/or washing of front face 2.1. By positioning cleaning device 1 with non-contacting portion 11 facing the printhead 2, carriage 17 is able to reciprocate across the printer through both cleaning zone 26 and printing zone 27 (see FIG. 6) without printhead 2 contacting cleaning device 1. Thus, flinging of ink due to movement of printhead 2 into a cleaning blade caused by the carriage motion is eliminated. Additionally, since carriage 17 can reciprocate through the cleaning zone 26 without any contact between printhead 2 and cleaning device 1, it is possible to eliminate special modes in the electronics or hardware of a printer which limit carriage travel to only printing zone 27 during the print mode and permit movement to cleaning zone 26 only during a cleaning mode as is required in ink jet printers that include stationary blades located along a side of printing zone 27. However, the present invention can also be included in printers which limit the travel of carriage 17 to only the printing zone 27 during printing and intermittently move carriage 17 to cleaning zone 26 for cleaning where the distance of travel of carriage 17 is desired to be reduced to obtain higher speeds of printing. Additionally, since non-contacting portion 11 faces the printhead during printing, cleaning device 1 can be located adjacent printing zone 27 without contacting the printhead even when large printheads, such as multi-color printheads, which partially extend beyond the side of the recording medium during printing are used. The location of cleaning device 1 closely adjacent to printing zone 27 permits the body of the printer to be made less wide so that the printer requires less desk-top space.

Numerous methods for controlling the operation of cleaning device 1 are contemplated. For example, cleaning device 1 can be initially oriented with non-contacting portion 11 facing printhead 2 and can be initiated during power-up, when the carriage 17 is at a left-most position and immediately in front of cleaning device 1, to rotate thereby effecting cleaning of printhead nozzle face 2.1. After completion of cleaning, cleaning device 1 would continue to rotate until non-contacting portion 11 is positioned adjacent printhead 2. Cleaning device 1 would remain in this position until needed. After cleaning has been accomplished, carriage 17 can be reciprocated through only zone 27 or through both zones 26 and 27, with printing occurring in zone 27, without any interference from cleaning device 1. During operation, carriage 17 can be moved to and stopped in cleaning zone 26 so that cleaning can be performed, the non-contacting portion 11 of cleaning device 1 always facing towards printhead 2 when cleaning is completed.

Although the teachings of the present invention have been discussed with reference to specific preferred embodiments, it is understood that various modifications, such as the provision of more than one wiping blade 3 or wet washing blade 9, may be made without departing from the spirit and scope of the invention as defined by the following claims.

What is claimed is:

1. A printhead nozzle cleaning device comprising:

a supporting member having a length and an outer circumferential surface;

an elongate wiping blade member attached to and extending radially outward from said outer circumferential surface of said supporting member and extending along substantially the entire length of said supporting member;

a wet washing blade member attached to and extending radially outward from said outer circumferential surface of said supporting member and extending along substantially the entire length of said supporting member along a path substantially parallel to said elongate wiping blade member; and rotation means for rotating said supporting member.

2. The device according to claim 1, wherein said supporting member is cylindrical.

3. The device according to claim 1, further comprising cleaning means for cleaning said elongate wiping blade member.

4. The device according to claim 3, wherein said cleaning means is a sponge covered by a polymer fabric or mesh.

5. The device according to claim 3, further comprising wetting means for supplying said cleaning means with a cleaning solution.

6. The device according to claim 5, wherein said wetting means also supplies said wet washing blade member with the cleaning solution.

7. The device according to claim 6, wherein said wetting means includes a source of cleaning solution and wicking means for wicking cleaning solution from said source to said cleaning means.

8. The device according to claim 6, wherein said cleaning means supplies said cleaning solution to said wet washing blade member directly through intimate contact.

9. The device according to claim 1, wherein said elongate wiping blade member is resiliently flexible.

10. The device according to claim 1, wherein said elongate wiping blade member and said wet washing blade member are attached to and extend along only a portion of said circumference of said supporting member whereby a complete revolution of said supporting member results in a blade contacting portion and a blade non-contacting portion of said device.

11. The device according to claim 1, wherein said wet washing blade member is a sponge.

12. The device according to claim 1, wherein said wet washing blade member is a sponge covered by a polymer fabric or mesh.

13. The device according to claim 1, further comprising wetting means for supplying said wet washing blade member with a cleaning solution.

14. The device according to claim 1, wherein said supporting member is cylindrical and said elongate wiping blade member and said wet washing blade member are attached to an extend along a helical path on said outer circumferential surface of said cylindrical supporting member.

15. The device according to claim 1, wherein said rotation means includes a D.C. motor.

16. The device according to claim 15, wherein said rotation means also includes an output speed reduction means attached between said D.C. motor and said supporting member.

17. A printer comprising:

a printhead having a plurality of nozzles; and a printhead nozzle cleaning device including:

a supporting member having a length and an outer circumferential surface;

an elongate wiping blade member attached to and extending radially outward from said outer circumferential surface of said supporting member and extending along substantially the entire length of said supporting member;

a wet washing blade member attached to and extending radially outward from said outer circumferential surface of said supporting member and extending along substantially the entire length of said supporting member along a path substantially parallel to said elongate wiping blade member; and rotation means for rotating said supporting member.

18. The printer according to claim 17, wherein said supporting member is cylindrical.

19. The printer according to claim 17, wherein said elongate wiping blade member is resiliently flexible.

20. The printer according to claim 21, wherein said elongate wiping blade member and said wet washing blade member are attached to and extend along only a portion of the circumference of said supporting member whereby a complete revolution of said supporting member results in a blade contacting portion and a blade non-contacting portion of said device being positioned adjacent said printhead.

21. The printer according to claim 17, wherein said elongate wiping blade member is made from rubber.

22. The printer according to claim 17, wherein said printhead is mounted on a carriage which reciprocates across a motion path in said printer.

23. The printer according to claim 17, further comprising cleaning means for cleaning said elongate wiping blade member and said wet washing blade member, said cleaning means including wetting means for supplying said cleaning means with a cleaning solution.

24. The printer according to claim 17, wherein said supporting member is cylindrical and said elongate wiping blade member and said wet washing blade member are attached to and extend along a helical path on said outer circumferential surface of said cylindrical supporting member.

25. The printer according to claim 17, further comprising a cleaning means for cleaning said elongate wiping blade member.

26. The printer according to claim 25, wherein said cleaning means is a sponge covered by a polymer fabric or mesh.

27. The printer according to claim 25, further comprising wetting means for supplying said cleaning means with a cleaning solution.

28. The printer according to claim 17, further comprising a platen for supporting a recording medium in front of said printhead, and a platen motor for rotating said platen so that the recording medium is conveyed past said printhead, wherein said rotation means includes said platen motor and a clutch means for alternately coupling said platen motor with said platen and said supporting member.

29. The printer according to claim 17, further comprising a carriage mounted in said printer for reciprocating movement therein, said printhead being mounted on said carriage, and a carriage motor for reciprocating said carriage, wherein said rotation means includes said carriage motor and a clutch means for alternately coupling said carriage motor with said carriage and said supporting member.

30. The printer according to claim 17, wherein said rotation means includes a D.C. motor.

31. The printer according to claim 30, wherein said rotation means also includes an output speed reduction means attached between said D.C. motor and said supporting means.

32. The printer according to claim 17, wherein said plurality of nozzles are arranged in at least one line, and said supporting member has a longitudinal axis substantially parallel to said at least one line of nozzles.

33. A printer comprising:

a printhead having a plurality of nozzles;

a carriage mounted in said printer for reciprocating movement therein, said printhead being mounted on said carriage, said carriage reciprocating through a motion path having a printing zone and a cleaning zone located adjacent said printing zone; and a printhead cleaning device located in said cleaning zone and comprising:

a cylindrical supporting member having a length and an outer circumferential surface;

an elongate wiping blade member attached to and extending radially outward from said outer circumferential surface of said supporting member and extending along substantially the entire length of said supporting member in a helical path;

a wet washing blade member attached to and extending radially outward from said circumferential surface of said supporting member and extending along substantially the entire length of said supporting member along a path substantially parallel to said elongate wiping blade member; and rotation means for rotating said supporting member.

34. The printer according to claim 33, further comprising cleaning means for cleaning said elongate wiping blade member.

35. The printer according to claim 34, wherein said cleaning means is a sponge covered by a polymer fabric or mesh.

36. The printer according to claim 33, further comprising cleaning means for cleaning said elongate wiping blade member and said wet washing blade member.

37. A printer comprising:

a printhead having a plurality of nozzles arranged in a substantially straight line; and a printhead cleaning device including:

a cylindrical supporting member having a length and an outer circumferential surface, said cylindrical supporting member having a longitudinal axis substantially parallel to said line of nozzles and being fixedly mounted in said printer for only rotation about said longitudinal axis;

an elongate wiping blade member attached to and extending radially outward from said circumferential surface of said supporting member and extending along substantially the entire length of said supporting member; and rotation means for rotating said supporting member about said longitudinal axis, wherein a single revolution of said supporting member causes said elongate wiping blade member to contact all of the nozzles in said line of nozzles.

38. The printer according to claim 37, wherein said printhead is mounted on a carriage which reciprocates across a motion path in said printer so that said line of nozzles extends in a vertical direction, said motion path including a printing zone and a cleaning zone located adjacent to said printing zone, said supporting member being vertically mounted in said printer in said cleaning zone.

39. The printer according to claim 37, wherein said printhead cleaning device further comprises cleaning means for cleaning said elongate wiping blade member, said cleaning means including:

a sponge covered by a polymer fabric or mesh located on a side of said supporting member opposite from said printhead, for contacting said elongate wiping blade member as said supporting member rotates; and wetting means for supplying said sponge with a cleaining solution.

40. The printer according to claim 37, wherein said elongate wiping blade member is attached to and extends along a helical path on said outer circumferential surface of said cylindrical supporting member.

41. A printer comprising:

a printhead having a plurality of nozzles;

a carriage mounted in said printer for reciprocating movement therein, said printhead being mounted on said carriage, said carriage reciprocating through a motion path having a printing zone and a cleaning zone located adjacent to said printing zone; and a printhead cleaning device located in said cleaning zone and comprising:

a cylindrical supporting member having a length and an outer circumferential surface, said cylindrical supporting member having a longitudinal axis fixedly mounted in said cleaning zone for only rotation about said longitudinal axis;

an elongate wiping blade member attached to and extending radially outward from said outer circumferential surface of said supporting member and extending along substantially the entire length of said supporting member, said elongate wiping blade member being attached to and extending along only a first portion of a circumference of said supporting member, wherein said elongate wiping blade member defines a radial outermost surface of said printhead cleaning device along said first portion of said circumference of said supporting member and said outer circumferential surface of said supporting member defines a radial outermost surface of said printhead cleaning device along a second portion of said circumference of said supporting member, wherein a complete revolution of said supporting member results in a blade contacting portion of said cleaning device when said first portion is opposed to said printhead and a blade-nonconducting portion of said cleaning device when said second portion is opposed to said printhead; and rotation means for rotating said supporting member, said rotation means placing said blade-noncontacting portion opposed to said printhead during a printing operation so that said printhead can enter said cleaning zone during the printing operation without contacting said printhead cleaning device.

* * * * *